US007374429B2

(12) United States Patent
Cronch et al.

(10) Patent No.: US 7,374,429 B2
(45) Date of Patent: May 20, 2008

(54) CONNECTOR ASSEMBLY

(75) Inventors: Daniel F. Cronch, Austin, TX (US); Alexander W. Barr, Austin, TX (US); Wing C. Chow, Austin, TX (US); Steven Feldman, Cedar Park, TX (US); Richard J. Scherer, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/114,287

(22) Filed: Apr. 26, 2005

(65) Prior Publication Data

US 2006/0240697 A1 Oct. 26, 2006

(51) Int. Cl.
*H01R 12/00* (2006.01)

(52) U.S. Cl. ..... 439/67; 439/496

(58) Field of Classification Search ..... 439/67, 439/77, 492, 495, 496, 497, 499, 326, 329
See application file for complete search history.

(56) References Cited

U.S. PATENT DOCUMENTS

| | | | | |
|---|---|---|---|---|
| 3,629,787 | A | 12/1971 | Wilson | |
| 3,989,336 | A | 11/1976 | Rizzio, Jr. et al. | |
| 4,111,510 | A * | 9/1978 | Zurcher | 439/67 |
| 4,181,386 | A | 1/1980 | Olsson | |
| 4,379,608 | A | 4/1983 | Olsson et al. | |
| 4,416,497 | A | 11/1983 | Brandsness et al. | |
| 4,457,575 | A | 7/1984 | Davis et al. | |
| 4,583,800 | A | 4/1986 | Roberts et al. | |
| 4,684,183 | A * | 8/1987 | Kinoshita et al. | 439/77 |
| 4,941,837 | A | 7/1990 | Nakamura | |
| 5,009,607 | A | 4/1991 | Gordon et al. | |
| 5,383,788 | A | 1/1995 | Spencer | |
| 5,415,573 | A * | 5/1995 | Chen et al. | 439/876 |
| 5,697,794 | A * | 12/1997 | Mosquera | 439/67 |
| 5,726,432 | A | 3/1998 | Reichardt | |
| 6,039,600 | A * | 3/2000 | Etters et al. | 439/496 |
| 6,077,124 | A | 6/2000 | Etters et al. | |
| 6,203,352 | B1 | 3/2001 | Murakami et al. | |
| 6,234,820 | B1 | 5/2001 | Perino et al. | |
| 6,280,241 | B2 | 8/2001 | Herlinger et al. | |
| 6,361,358 | B1 * | 3/2002 | Kajinuma | 439/497 |
| 6,447,321 | B1 | 9/2002 | Perino et al. | |
| 6,881,085 | B2 * | 4/2005 | Yahiro et al. | 439/326 |
| 2003/0114043 | A1 | 6/2003 | Kuo | |
| 2004/0203274 | A1 | 10/2004 | Peng | |
| 2005/0026498 | A1 | 2/2005 | Ikeda et al. | |
| 2005/0112928 | A1 | 5/2005 | Funatsu | |

FOREIGN PATENT DOCUMENTS

| | | |
|---|---|---|
| DE | 1920988 | 11/1970 |
| DE | 19832011 A | 2/2000 |
| JP | 08031526 | 2/1996 |
| WO | WO 91/01567 | 2/1991 |

* cited by examiner

*Primary Examiner*—Thanh-Tam Le
(74) *Attorney, Agent, or Firm*—Melanie G. Gover

(57) ABSTRACT

A connector assembly includes a frame mounted on a printed circuit substrate having a plurality of contact pads, and a spring member configured for insertion into the frame. The spring member has a flexible circuit supported thereon. The spring member and frame are shaped to exert biasing forces in two non-parallel directions when the spring member is inserted into the frame.

23 Claims, 5 Drawing Sheets

CONNECTOR ASSEMBLY

FIELD

The present invention relates to electrical connectors, and particularly to a connector assembly for providing a direct interface between two printed circuits.

BACKGROUND

Numerous examples exist for connecting two printed circuits to each other, and more particularly, for connecting a flexible circuit to a rigid printed circuit board or to another flexible circuit. Conventional methods of interconnecting printed circuits include the use of separate connector structures on both of the printed circuits to be electrically connected. With regard to flexible circuits, well-known pin and socket connectors are commonly employed to interconnect flexible circuits with other printed circuit boards or flexible circuits. While generally suitable for their intended purpose, such commonly available connectors suffer from several deficiencies. For example, the connectors are generally larger than allowable for modern electronic devices having ever shrinking dimensions. In addition, the currently available connectors often have a relatively complicated physical structure, resulting in high manufacturing costs.

In some applications, the use of separate connector structures has been replaced with pressure connectors that establish electrical contact between printed circuits by mechanically pressing the contact pad or terminal portions of one printed circuit against those of another printed circuit. Such pressure connections are often ineffective at accurately aligning printed circuits having very narrow and closely spaced contact pads. Further, such pressure connectors are often difficult to reliably disengage and re-engage, and thus fail to provide reliable connection between the printed circuits, causing unsatisfactory electrical performance.

Due to the drawbacks and shortcomings of current connection devices and methods, there exists a need in the industry for a connector assembly that is easy to manufacture, provides accurate alignment, and dependably engages and disengages to provide reliable electrical connection between printed circuits.

SUMMARY

One aspect of the invention described herein provides a connector assembly. In one embodiment according to the invention, the connector assembly comprises a frame mounted on a printed circuit substrate having a plurality of contact pads, and a spring member configured for insertion into the frame. The spring member has a flexible circuit supported thereon. The spring member and frame are shaped to exert biasing forces in two non-parallel directions when the spring member is inserted into the frame.

In another embodiment according to the invention, the connector assembly comprises a conductive frame mounted on a printed circuit, and a connector portion configured for insertion into the frame. The frame is electrically connected to a ground of the printed circuit, and the printed circuit has a plurality of printed circuit contact pads within an area bordered by the frame. The connector portion has a flexible circuit supported thereon. The flexible circuit has a plurality of contact pads for engagement with the plurality of printed circuit contact pads. At least one of the frame and connector portion comprises a spring portion, and the frame and connector portion are cooperatively shaped to exert biasing forces in two non-parallel directions when the connector portion is inserted into the frame.

In another aspect, the invention described herein provides a connector assembly for providing a direct interface between two printed circuits. In one embodiment according to the invention, the connector assembly comprises a frame configured for mounting on a first printed circuit, and a connector portion configured for insertion into the frame and adapted to support a second printed circuit thereon. When the connector portion with the second printed circuit thereon is inserted into the frame, the connector portion and the frame cooperatively exert a first biasing force between the first printed circuit and the second printed circuit, and a second biasing force between the second printed circuit and the frame.

DETAILED DESCRIPTION

Figure 1:
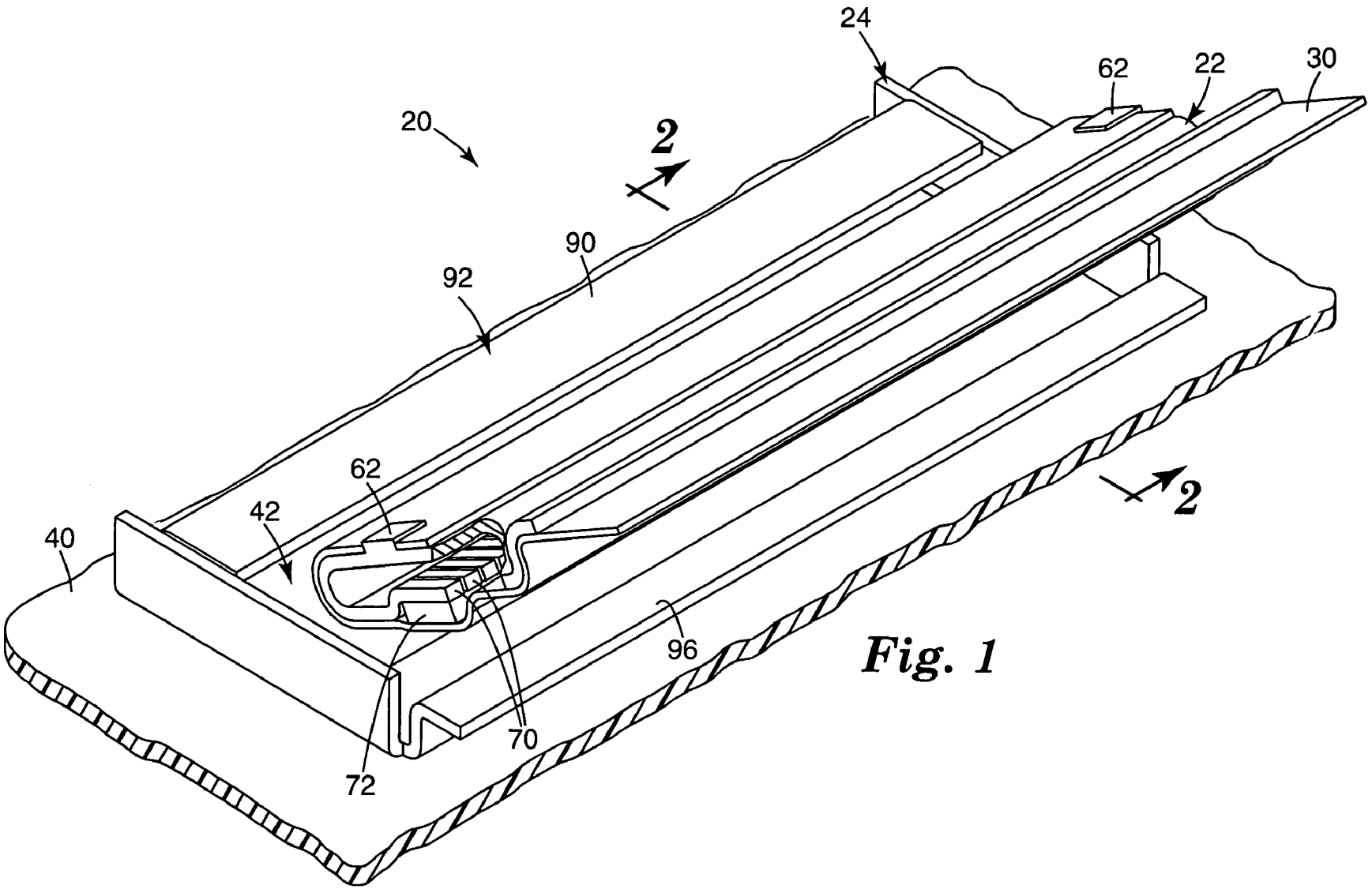
FIG. 1 is a perspective illustration of one embodiment of a connector assembly according to the invention, in a disengaged configuration, the connector assembly including a spring member with a flexible circuit attached thereto, and a frame mounted on a printed circuit.

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the present invention is defined by the appended claims.

FIGS. 1-4 illustrate one embodiment of a connector assembly 20 in accordance with the present invention. The connector assembly 20 includes a spring member 22 and a frame 24. The spring member 22 is configured for insertion into the frame 24 while having a flexible circuit 30 supported thereon. The frame 24 is configured for mounting on a printed circuit substrate 40 and defines a receiving space 42 for receiving the spring member 22 therein. The printed circuit substrate 40 has a plurality of contact pads 44 thereon, and the flexible circuit 30 includes a plurality of contact pads 46 for engagement with corresponding contact pads 44 of the printed circuit substrate 40. When the spring member 22 with the flexible circuit 30 thereon is inserted into the frame 24, direct electrical connection is made between the contact pads 46 of the flexible circuit 30 and the contact pads 44 of the printed circuit substrate 40.

In the illustrated embodiment, the frame 24 includes a front surface mount 50 extending along the width of the frame 24, and a rear surface mount 52, also extending along the width of the frame 24. The front and rear surface mounts 50, 52 act to stiffen the printed circuit substrate 40 and thereby resist bowing of the printed circuit substrate 40 away from the spring member 22 when mated with the frame 24. If the frame 24 is electrically conductive, the front surface mount 50 and rear surface mount 52 may comprise solder mounts configured for connection to a ground 60 of the printed circuit substrate 40. In one embodiment, the frame 24 is fabricated from a single flat metal blank stamping which is bent and/or folded to form the completed frame. In other embodiments, the frame is assembled from multiple elements which are electrically conductive, electrically insulative, or a combination thereof.

Figure 2:
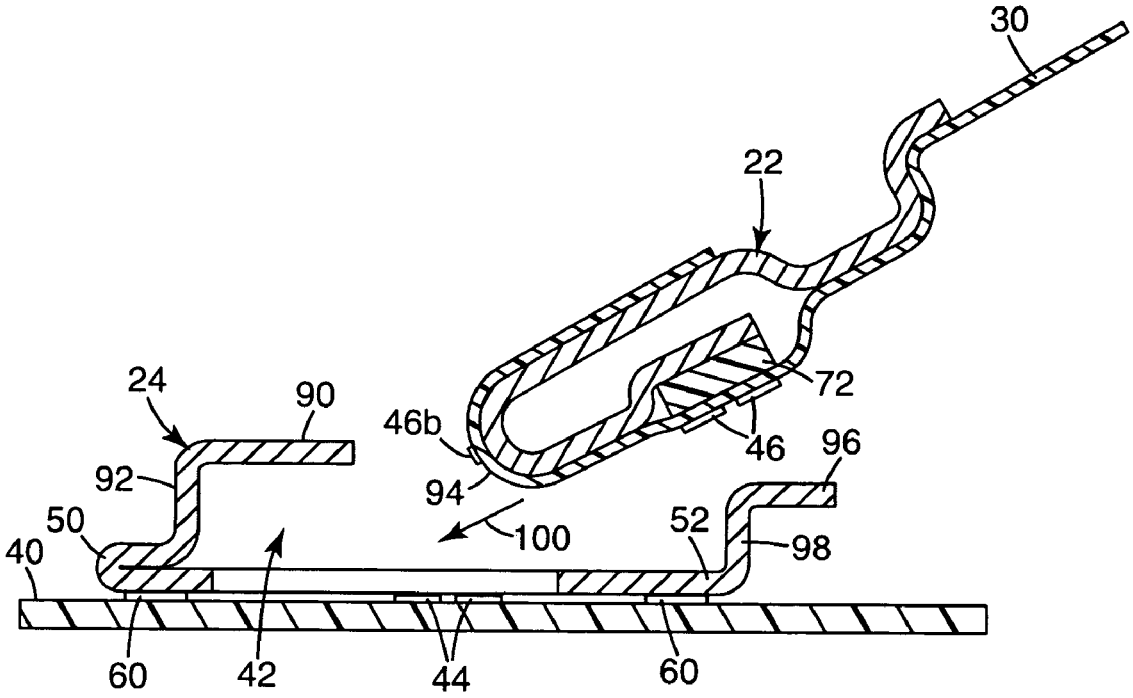
FIG. 2 is a cross-sectional illustration of the connector assembly taken along line 2-2 of FIG. 1.
Figure 4:
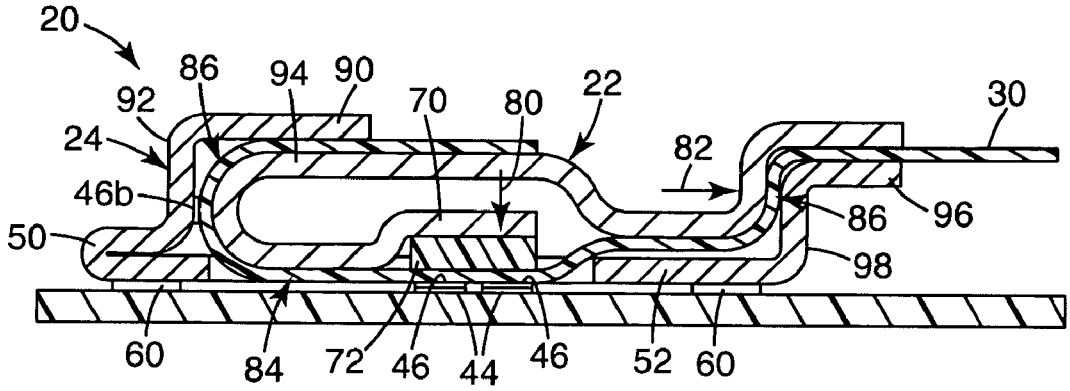
FIG. 4 is a cross-sectional illustration of the connector assembly taken along line 4-4 of FIG. 3.

As best seen in FIGS. 1, 2, and 4, the spring member 22 is generally S-shaped and includes retaining tabs 62 for securing the flexible circuit 30 to the spring member 22. In the illustrated embodiment, the retaining tabs 62 extend from the lateral edges of the spring member 22 and are folded over the edges of the flexible circuit 30. In other embodiments, the retaining tabs 62 may extend from a central portion of the spring member 22 and extend through the flexible circuit 30. In other embodiments, the flexible circuit 30 is secured to the spring member 22 using other suitable engagement means, including, but not limited to, adhesive bonding, screws, pins, and the like.

In one embodiment, the spring member 22 includes a plurality of spring fingers 70 adjacent at least a portion of the contact pads 46 of the flexible circuit 30. The spring fingers 70 are positioned to urge the contact pads 46 of the flexible circuit 30 against corresponding contact pads 44 of the printed circuit substrate 40. In one embodiment, an elastomeric material layer 72 is positioned between the spring fingers 70 and the contact pads 46 of the flexible circuit 30 to provide additional compliance and to more evenly distribute forces from the spring fingers 70 to the contact pads 46 of the flexible circuit 30. In one embodiment, the elastomeric material layer 72 comprises an elastomeric boot that extends over one or more of the spring fingers 70. The presence of an elastomeric material layer 72 between the spring member 22 and the contact pads 46 of the flexible circuit 30 is particularly beneficial in embodiments having multiple rows of contact pads 44, 46.

In the illustrated embodiment, when the generally S-shaped spring member 22 is inserted into the frame 24, the spring member 22 and frame 24 cooperate to exert biasing forces in two non-parallel directions. In one embodiment, the biasing forces are exerted in two substantially orthogonal directions. In the embodiment illustrated in FIGS. 1-4, a first biasing force is exerted in the direction of arrow 80, substantially perpendicular to the plane of the printed circuit substrate 40, and a second biasing force is exerted in the direction of arrow 82, substantially parallel to a plane of the printed circuit substrate 40 (FIG. 4). The first biasing force 80 urges a first portion 84 of the flexible circuit 30 against the printed circuit substrate 40, such that the contact pads 46 of the flexible circuit 30 are pressed against the contact pads 44 of the printed circuit substrate 40. The second biasing force 82 urges at least a second portion 86 of the flexible circuit 30 against the frame 24. As best seen in FIG. 4, the cooperating shapes of spring member 22 and frame 24 results in the second biasing force 82 urging portion 86 of the flexible circuit 30 against the frame 24 at the front edge of the connector assembly 20, and also urging portion 86' of the flexible circuit 30 against the frame 24 at the back edge of the connector assembly 20.

In one embodiment, where the frame 24 is electrically conductive and connected to a ground 60 of the printed circuit substrate 40, at least one ground contact pad **46*b* is positioned on at least one of the second portions 86, 86' of the flexible circuit 30, such that the at least one contact pad 46*b* is urged into engagement with the frame 24 by the second biasing force 82. In this manner, a continuous ground and signal return path is established from the flexible circuit 30 to the printed circuit substrate 40 via the frame 24. In one embodiment, the at least one ground contact pad 46*b* is positioned such that the ground contact pad 46*b* engages the frame 24 with a wiping action. The wiping action cleans the mating surfaces of the ground contact pad 46*b* and frame 24 of oxidation or other contaminants and provides a more reliable electrical connection therebetween. In one embodiment, the at least one ground contact pad 46*b* is positioned such that the ground circuit between contact pad 46*b* and frame 24 is completed prior to engagement of contact pads 46 with the printed circuit substrate 40**.

In one embodiment, the frame 24 includes at least one guide feature configured to direct the spring member 22 into the frame 24 at an oblique insertion angle with respect to the printed circuit substrate 40, such that the contact pads 46 of the flexible circuit 30 engage the corresponding contact pads 44 of the printed circuit substrate 40 with a wiping action. The wiping action cleans the mating surfaces of the contact pads 44, 46 of oxidation or other contaminants and provides a more reliable electrical connection between the flexible circuit 30 and the printed circuit substrate 40.

As best seen in FIG. 2, a first guide feature 90 adjacent the front portion 92 of the frame 24 is configured to capture a front edge 94 of the spring member 22 as the spring member 22 is inserted into the receiving space 42 of the frame 24. In one embodiment, the first guide feature 90 forms a spring element to aid in biasing the flexible circuit 30 against the printed circuit substrate 40. A second guide feature 96 adjacent the back portion 98 of the frame 24 is configured to prevent horizontal insertion of spring member 22 into the frame 24.

Figure 3:
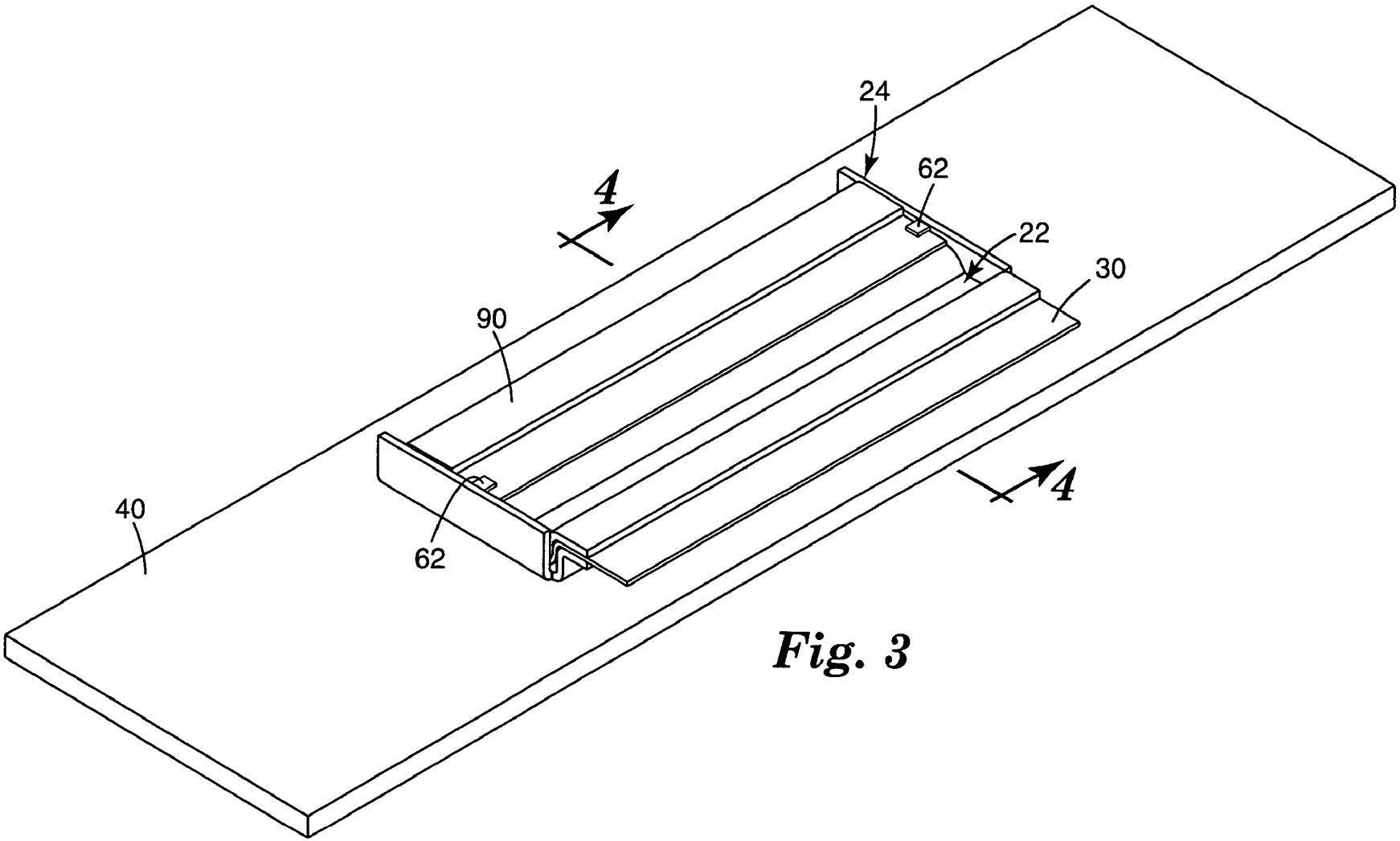
FIG. 3 is a perspective illustration of the connector assembly of FIG. 1, in an engaged configuration.

Mating between the spring member 22 and frame 24 is illustrated in FIGS. 1-4. In FIGS. 1 and 2, the spring member 22 is positioned adjacent the frame 24 at an oblique angle with respect to the printed circuit substrate 40. The oblique angle mating of the spring member 22 and the frame 24 permits the frame 24 to be mounted away from an edge of the printed circuit substrate 40 without requiring space on the printed circuit substrate 40 that must be kept free of surface mounted components to allow engagement and disengagement of the connector assembly. The spring member 22 is prevented from vertical insertion into the frame 24 (in a direction generally orthogonal to the plane of the printed circuit substrate 40) by the first guide feature 90. The spring member 22 is prevented from horizontal insertion into the frame 24 (in a direction generally parallel with the plane of the printed circuit substrate 40) by the second guide feature 96. As the spring member 22 with the flexible circuit 30 thereon is directed into the receiving space 42 of the frame 24 in the direction of arrow 100, the front edge 94 of the spring member 22 is captured by the first guide feature 90 of the frame 24. As the spring member 22 continues to be inserted into the frame 24, a wiping action is provided between the contact pads 46 of the flexible circuit 30 and the contact pads 44 on the printed circuit substrate 40, assuring good electrical contact therebetween. As the spring member 22 is fully inserted into the frame 24, the back edge of the spring member 22 is rotated toward the printed circuit substrate 40 (FIGS. 3 and 4). In one embodiment, the spring member 22 and frame 24 have a mated height of less than about 1.2 millimeters. The spring member 22 and frame 24 are configured such that spring member 22 and frame 24 are maintained in an engaged condition, such as by a suitable latching features.

Figure 5:
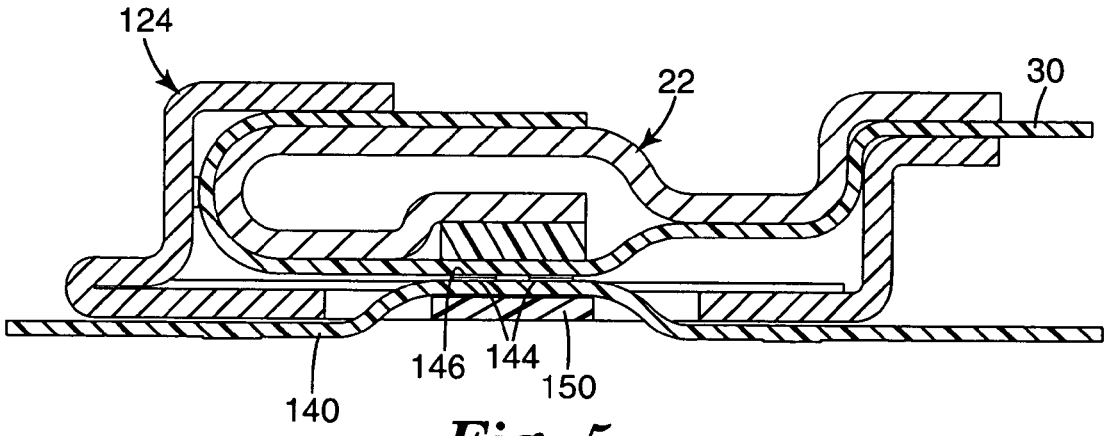
FIG. 5 is a cross-sectional illustration of another embodiment of a connector assembly according to the invention, for use with a flexible printed circuit substrate.

In FIGS. 1-4, the printed circuit substrate 40 is illustrated as a rigid printed circuit board. However, in other embodiments according to the invention, the printed circuit substrate 40 is a flexible circuit. In FIG. 5 a flexible printed circuit substrate 140 is illustrated having a frame 124 mounted thereon. The frame 124 is constructed as described with respect to frame 24 above, and further includes a contact support member 150 adapted to extend under the flexible printed circuit substrate 140 and maintain the contact pads 144 of the flexible printed circuit substrate 140 in close relationship to the contact pads 46 of the flexible circuit 30 on the spring member 22.

Figure 6:
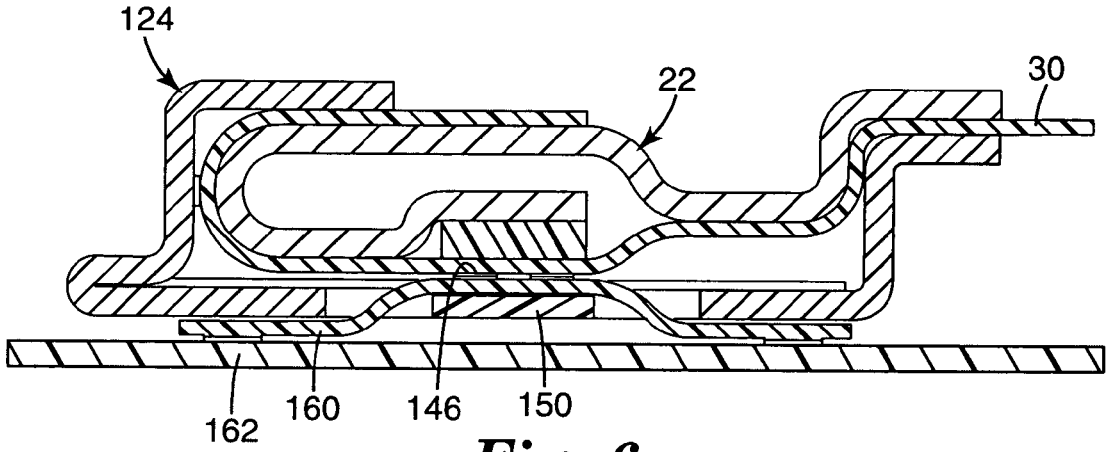
FIGS. 6 and 7 are cross-sectional illustrations of the connector assembly of FIG. 5, using an intermediate printed circuit substrate.
Figure 7:
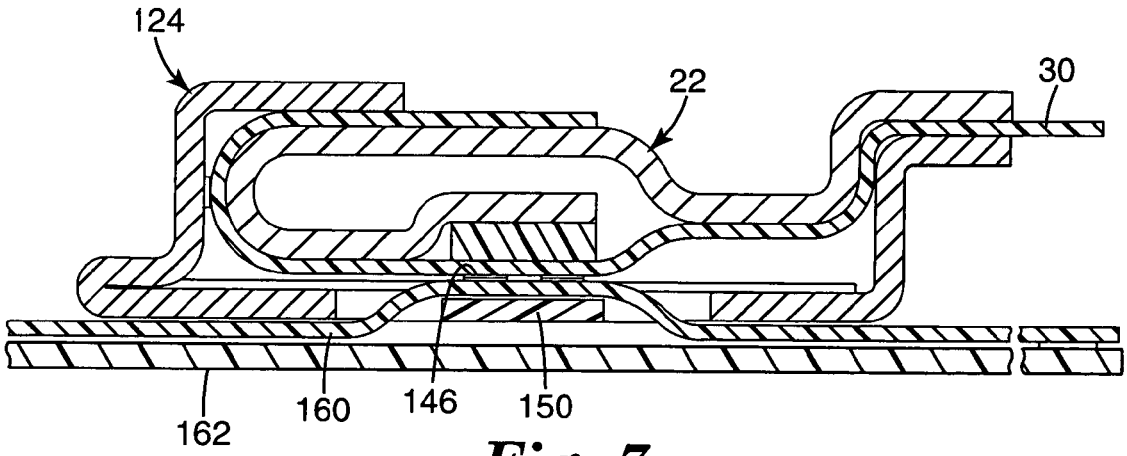

In one embodiment, as illustrated in FIG. 6, the printed circuit substrate 40 is an intermediate printed circuit substrate 160. The intermediate printed circuit substrate 160 is electrically connected to a base printed circuit substrate 162. In FIG. 6, the intermediate printed circuit substrate 160 is illustrated as a flexible circuit, and the base printed circuit substrate 162 is illustrated as a rigid printed circuit board. In other embodiments, base printed circuit substrate 162 is a flexible circuit. In one embodiment, the intermediate printed circuit substrate 160 is connected to the base printed circuit substrate 162 at a location within the footprint of the frame 24 (FIG. 6). In another embodiment, the intermediate printed circuit substrate 160 is connected to the base printed circuit substrate 162 at a location outside a footprint of the frame 24 (FIG. 7).

Figure 8:
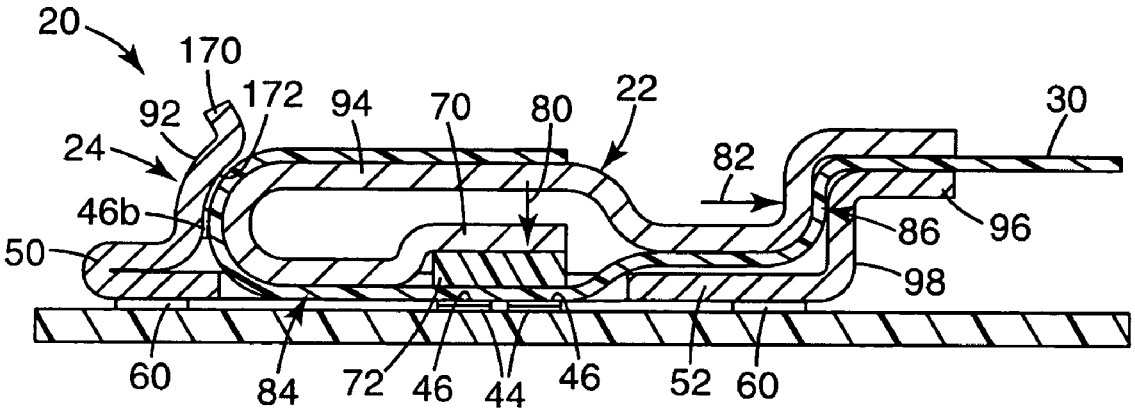
FIG. 8 is a cross-sectional illustration of another embodiment of a connector assembly according to the invention.

In another embodiment of the connector assembly, the frame 24 is configured to allow substantially vertical insertion of the spring member 22 into the frame 24. As illustrated in FIG. 8, the front portion 92 of the frame 24 is provided with a lead-in feature 170 configured to guide front edge 94 of the spring member 22 into frame 24 as the spring member 22 is inserted into the receiving space 42 of the frame 24 in a direction substantially normal to the plane of printed circuit board 40. Front portion 92 of frame 24 is further provided with an engagement portion 172 configured to substantially match the shape of front edge 94 of spring member 22, such that engagement portion 172 discourages removal of spring member 22 from frame 24.

In each of the embodiments described herein, all polymer parts are molded from suitable thermoplastic material having the desired mechanical and electrical properties for the intended application. The conductive metal parts are made from, for example, plated copper alloy material, although other suitable materials will be recognized by those skilled in the art. The connector assembly materials, geometry and dimensions are all designed to maintain a specified impedance throughout the assembly.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A connector assembly comprising:

a frame mounted on a printed circuit substrate having a plurality of contact pads and having front and back portions extending along the width of the frame; and a spring member configured for insertion into the frame and having a flexible circuit supported thereon, wherein the spring member and frame are shaped to cooperatively exert biasing forces in two non-parallel directions after the spring member is inserted into the frame such that a first biasing force urges a first portion of the flexible circuit against the contact pads of the printed circuit substrate and a second biasing force urges a second portion of the flexible circuit against the front portion of the frame and a third portion of the flexible circuit against the back portion of the frame;

wherein the frame includes at least one guide feature to direct the spring member into the frame at an oblique insertion angle with respect to the printed circuit substrate.

2. The connector assembly of claim 1, wherein the spring member and frame are shaped to exert the first and second biasing forces in two substantially orthogonal directions.

3. The connector assembly of claim 2, wherein the spring member and frame are shaped to exert the first biasing force substantially perpendicular to a plane of the printed circuit substrate, and the second biasing force substantially parallel to a plane of the printed circuit substrate.

4. The connector assembly of claim 1, wherein the flexible circuit includes a plurality of contact pads for engagement with corresponding contact pads of the printed circuit substrate, and wherein the at least one guide feature directs the spring member into the frame such that the flexible circuit contact pads engage the corresponding printed circuit substrate contact pads with a wiping action.

5. The connector assembly of claim 1, wherein the printed circuit substrate is rigid.

6. The connector assembly of claim 1, wherein the printed circuit substrate is flexible.

7. The connector assembly of claim 6, wherein the frame further comprises a support member extending under the contact pads of the flexible printed circuit substrate.

8. The connector assembly of claim 6, wherein the flexible printed circuit substrate is an intermediate printed circuit substrate, and the intermediate printed circuit substrate is electrically connected to a base printed circuit substrate.

9. The connector assembly of claim 8, wherein the intermediate printed circuit substrate is electrically connected to a base printed circuit substrate at a location outside a footprint of the frame.

10. The connector assembly of claim 1, wherein the frame and spring member are each fabricated from a single piece of sheet metal.

11. The connector assembly of claim 1, wherein the frame and spring member have a mated height of less than 1.2 millimeters.

12. The connector assembly of claim 1, wherein the frame is mounted away from an edge of the printed circuit substrate.

13. A connector assembly comprising:

a frame mounted on a printed circuit substrate having a plurality of contact pads and having front and back portions extending along the width of the frame; and a spring member configured for insertion into the frame and having a flexible circuit supported thereon, wherein the spring member and frame are shaped to cooperatively exert biasing forces in two non-parallel directions after the spring member is inserted into the frame such that a first biasing force urges a first portion of the flexible circuit against the contact cads of the printed circuit substrate and a second biasing force urges a second portion of the flexible circuit against the front portion of the frame and a third portion of the flexible circuit against the back portion of the frame;

wherein the first portion of the flexible circuit includes a plurality of contact pads, and wherein the spring member comprises a plurality of spring fingers adjacent at least a portion of the flexible circuit contact pads, the spring fingers urging the flexible circuit contact pads against corresponding printed circuit substrate contact pads.

14. The connector assembly of claim 13, further comprising an elastomeric material positioned between the spring fingers and the flexible circuit contact pads.

15. A connector assembly comprising:

a frame mounted on a printed circuit substrate having a plurality of contact pads and having front and back portions extending along the width of the frame;

a spring member configured for insertion into the frame and having a flexible circuit supported thereon, wherein the spring member and frame are shaped to cooperatively exert biasing forces in two non-parallel directions after the spring member is inserted into the frame such that a first biasing force urges a first portion of the flexible circuit against the contact pads of the printed circuit substrate and a second biasing force urges a second portion of the flexible circuit against the front portion of the frame and a third portion of the flexible circuit against the back portion of the frame; and an elastomeric material positioned between the spring member and the flexible circuit contact pads.

16. A connector assembly comprising:

a frame mounted on a printed circuit substrate having a plurality of contact pads and having front and back portions extending along the width of the frame, wherein the frame is electrically conductive and connected to a ground of the printed circuit substrate;

a spring member configured for insertion into the frame and having a flexible circuit supported thereon, wherein the spring member and frame are shaped to cooperatively exert biasing forces in two non-parallel directions after the spring member is inserted into the frame;

wherein the flexible circuit includes a plurality of contact pads, and wherein the spring member and frame bias a first portion of the plurality of flexible circuit contact pads against the printed circuit substrate contact pads, and biases a second portion of the plurality of flexible circuit contact pads against the front portion of the frame and a third portion of the flexible circuit contact pads against the back portion of the frame.

17. A connector assembly comprising:

a conductive frame having front and back portions extending alone the width of the frame mounted on a printed circuit and electrically connected to a ground of the printed circuit, the printed circuit having a plurality of printed circuit contact pads within an area bordered by the frame;

a connector portion configured for insertion into the frame and having a flexible circuit supported thereon, the flexible circuit having a plurality of contact pads for engagement with the plurality of printed circuit contact pads;

wherein at least one of the frame and connector portion comprises a spring portion, and wherein the frame and connector portion are cooperatively shaped to exert biasing forces in two non-parallel directions after the connector portion is inserted into the frame such that a first biasing force urges a first portion of the flexible circuit against the contact pads of the printed circuit substrate and a second biasing force urges a second portion of the flexible circuit against the front portion of the frame and a third portion of the flexible circuit against the back portion of the frame.

18. The connector assembly of claim 17, wherein the printed circuit is rigid.

19. The connector assembly of claim 17, wherein the printed circuit is flexible.

20. The connector assembly of claim 19, wherein the frame further comprises a support member extending under the contact pads of the flexible printed circuit.

21. The connector assembly of claim 17, wherein at least one of the frame and connector portion are each fabricated from a single piece of sheet metal.

22. The connector assembly of claim 17, wherein the frame has a height of less than 1.2 millimeters.

23. The connector assembly of claim 17, wherein the frame is mounted away from an edge of the printed circuit.

* * * * *

UNITED STATES PATENT AND TRADEMARK OFFICE

CERTIFICATE OF CORRECTION

PATENT NO. : 7,374,429 B2
APPLICATION NO. : 11/114287
DATED : May 20, 2008
INVENTOR(S) : Daniel F. Cronch It is certified that error appears in the above-identified patent and that said Letters Patent is hereby corrected as shown below:

Drawings

In the drawings, Sheet 2, Fig. 4, above reference number 98, delete "86" and insert -- 86' --, therefore.

In the drawings, Sheet 5, Fig. 8, above reference number 98, delete "86" and insert -- 86' --, therefore.

Column 7

Line 7, in Claim 13, delete "cads" and insert -- pads --, therefore.

Column 8

Line 11, in Claim 17, delete "alone" and insert -- along --, therefore.

Signed and Sealed this

Twelfth Day of August, 2008

JON W. DUDAS
*Director of the United States Patent and Trademark Office*